US005513411A

United States Patent [19]

Simon

[11] Patent Number: 5,513,411

[45] Date of Patent: May 7, 1996

[54] BATTERY CONTACT CLEANING TOOL

[76] Inventor: Douglas Simon, 8311 Shawnee St., Philadelphia, Pa. 19118

[21] Appl. No.: 279,344

[22] Filed: Jul. 22, 1994

[51] Int. Cl.[6] ..... A47L 25/00

[52] U.S. Cl. ..... 15/111; 15/105; 15/176.1; 15/184; 15/202; 15/236.05; 15/236.06; 7/170

[58] Field of Search ..... 15/104.02, 104.05, 15/105, 111, 176.1–176.6, 184, 194, 202, 236.01, 236.05, 236.06, 236.08; 7/100, 157, 167, 169, 170

[56] References Cited

U.S. PATENT DOCUMENTS

| | | | |
|---|---|---|---|
| 952,884 | 3/1910 | Dickinson | 15/184 |
| 1,131,863 | 3/1915 | Phillips | 15/176.6 |
| 1,396,630 | 11/1921 | Higbee | 15/176.4 |
| 1,461,904 | 7/1923 | Hoyem | 15/111 |
| 1,710,127 | 4/1929 | Vaughn | 15/236.05 |
| 3,088,150 | 5/1963 | Sweeney | 15/184 |
| 3,797,055 | 3/1974 | Greene | 15/111 |
| 3,802,793 | 4/1974 | Simon | 408/204 |
| 3,946,456 | 3/1976 | Martin et al. | 15/105 |
| 3,964,122 | 6/1976 | Kurdy | 15/184 |
| 4,899,409 | 2/1990 | Cox, Jr. | 15/111 |
| 5,201,147 | 4/1993 | Francis | 15/105 |

FOREIGN PATENT DOCUMENTS

| | | | |
|---|---|---|---|
| 19308 | 9/1934 | Australia | 15/104.03 |
| 494418 | 7/1950 | Belgium | 15/105 |
| 1038546 | 9/1953 | France | 15/236.05 |
| 636489 | 5/1950 | United Kingdom | 15/236.06 |

OTHER PUBLICATIONS

"Battery Terminal Power Cleaners," page from E–Z Red Company Catalog, publication date unknown.

*Primary Examiner*—Mark Spisich
*Attorney, Agent, or Firm*—Synnestvedt & Lechner

[57] ABSTRACT

A battery contact cleaning tool which comprises a top portion, including a brush for cleaning the battery contact; a bottom portion for reaming and/or smoothing a battery contact; and an intermediate portion connecting the top portion and bottom portion. The present invention additionally provides for a cap to cover the brush located on the top portion of the battery cleaning tool.

4 Claims, 2 Drawing Sheets

FIG. 2
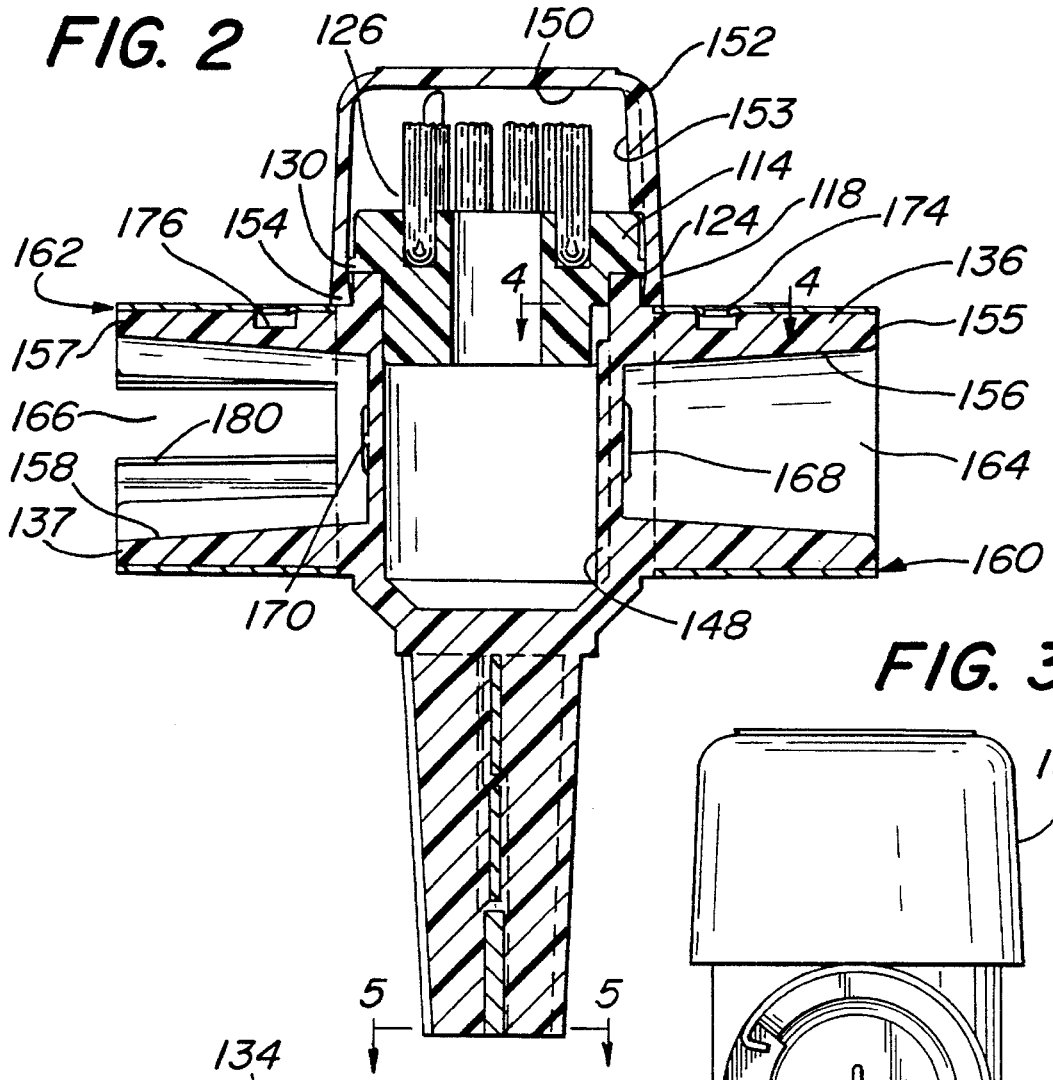
FIG. 3
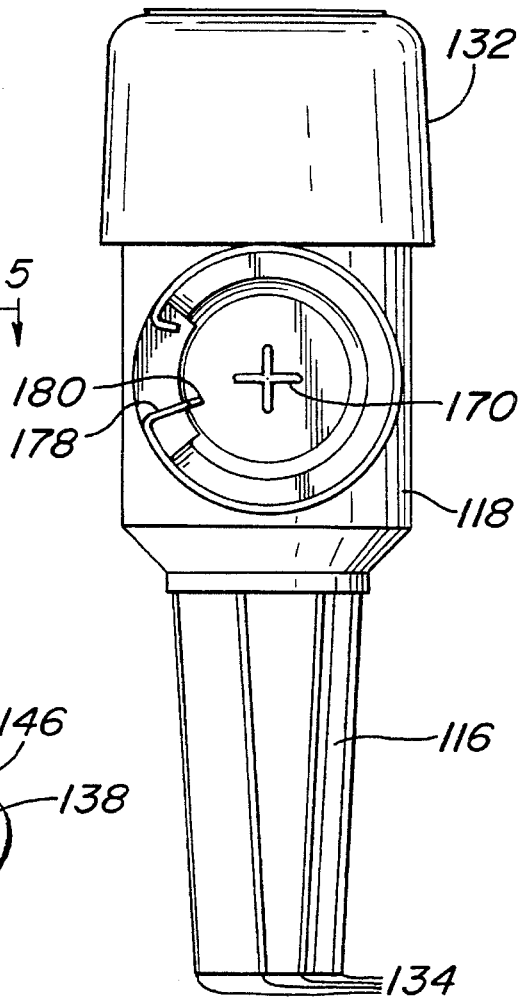
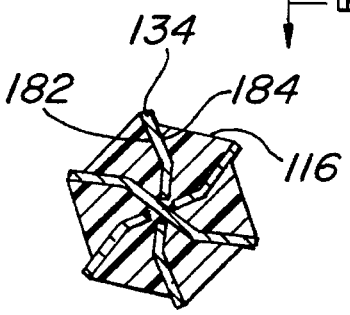
FIG. 5
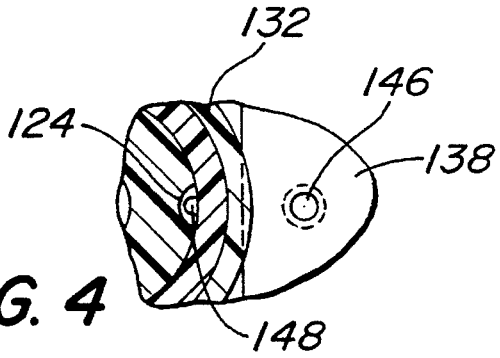
FIG. 4

BATTERY CONTACT CLEANING TOOL

FIELD OF THE INVENTION

This invention is directed to a battery contact cleaning tool, and more particularly to a battery contact cleaning tool designed to clean the contact surfaces of a battery such as the positive and negative poles thereof.

In order to optimize electrical conductivity between the poles of a battery and a battery terminal attached to a battery, the poles of the battery should be clean and in firm contact with the contact surface of a battery terminal. Accordingly, battery tools designed to ensure good electrical conductivity between a battery and a battery terminal should be able to ream or smooth the contact surfaces of the battery and a battery terminal.

U.S. Pat. No. 3,802,793 to Murray L. Simon is directed to battery tools. This patent discloses a battery tool of the type used for reaming and/or smoothing the conical contact surfaces of a battery terminal and the positive and negative tapered poles of a battery to provide good electrical contact.

While the tool disclosed in the Simon patent is advantageous for reaming or smoothing, it is limited in its use to certain battery types. Furthermore, it is designed and functions primarily to remove a layer of the soft metal, often lead, of a battery pole or terminal. In some instances, however, the user desires only to polish or clean the surface of the poles or terminal and wishes to avoid removing excessive amounts of the metal material comprising the contact surface. Use of the tool disclosed in the Simon patent may result in removal of excessive amounts of the surface material comprising the surface contact of a battery when, for example, a battery contact surface required only minimal polishing to maximize electrical conductivity between the battery poles and a battery terminal. Furthermore, the tool disclosed in the Simon patent is limited in application to certain battery types and requires the user to use other tools to clean battery contacts found on other battery types, such as side post mounted batteries and various marine batteries.

Based on the limitations of the prior art battery cleaning tools, applicant has discovered a need for a tool offering the ability to polish a wide variety of battery contact surfaces. On the other hand, applicant has also recognized the desirability of and need for a tool which can effectively ream or smooth battery contact surfaces when such an operation is required. However, it has heretofore been necessary for the battery technician to carry multiple tools in order to be prepared for the variety of battery cleaning situations that may arise. Applicant has found that the efficiency and speed with which battery posts and battery terminals are properly prepared can be improved by the provision of a single tool, which at once provides the ability to ream, smooth and polish the contact surfaces.

SUMMARY OF THE INVENTION

The tool of the present invention includes brush means for the cleaning of the contact surfaces of a variety of different battery types, including marine, industrial and truck batteries. In addition, the present battery tools also preferably include means for reaming and/or smoothing battery contacts.

Applicants have found that provision of brush means on the battery tool of the present invention enables the user to polish or clean a contact surface without excessive removal of the material which comprises the contact surface. As an example, when the fit between a battery pole and an attached terminal is sufficiently snug, one can use the brush means of the present invention to clean the contact surfaces without abrading away portions of the battery pole or terminal which facilitate the desired fit between the battery pole and terminals. The preferred battery cleaning tool of the present invention also comprises means to ream and/or smooth battery contact surfaces.

The battery cleaning tool of the present invention provides additional benefits in that it is inexpensive to manufacture and is designed to withstand the forces encountered in the course of cleaning a battery contact surface. The manufacturing process results in a battery cleaning tool which, by virtue of the method in which it is manufactured, is able to withstand the rotational forces experienced as the brush portion is used to clean a battery contact surface. In addition, the manufacturing process for the battery cleaning tool of the present invention permits a variety of brush types to be attached to the body of the battery cleaning tool, thereby allowing the manufacturer to prepare different variants of the battery cleaning tool at minimal expense.

The battery cleaning tool of the present invention is additionally designed to optimize hand-held use of the brush portion of the tool such that it is easily grasped by a user and rotated on a battery contact in order to clean the surface of the contact. Furthermore, the preferred battery cleaning tools of the present invention include a means for protecting the hand of the user from the sharp bristles of the brush portion when the tool is being used to ream or smooth.

Applicants have found that the advantageous characteristics and features discussed hereinabove are present in a preferred battery tool which comprises a tool body having a longitudinal axis; a top portion; a bottom portion; and an intermediate portion connecting the top and bottom portions wherein the bottom portion tapers away from the intermediate portion and the intermediate portion has a cavity, and preferably a cylindrical cavity, therein for receiving the top portion. The cavity preferably has an inner wall and a projection extending into the cavity from the surface of the inner wall. The top portion is designed to be received by the cavity, the top portion having a notch thereon for engaging the projection. In such embodiments, the top portion includes an integrally-mounted brush member.

BRIEF DESCRIPTION OF THE FIGURES

FIG. 2 is a cross-sectional view of the embodiment shown in FIG. 1 taken substantially along line 2—2 in FIG. 1.

FIG. 3 is a side elevation view of the battery cleaning tool shown in FIG. 1.

FIG. 4 is a broken away partial cross-section taken along line 4—4 of FIG. 2.

FIG. 5 is a cross-section taken along line 5—5 of FIG. 2.

DETAILED DESCRIPTION OF THE PREFERRED EMBODIMENTS

I. The Battery Tool

Figure 1:
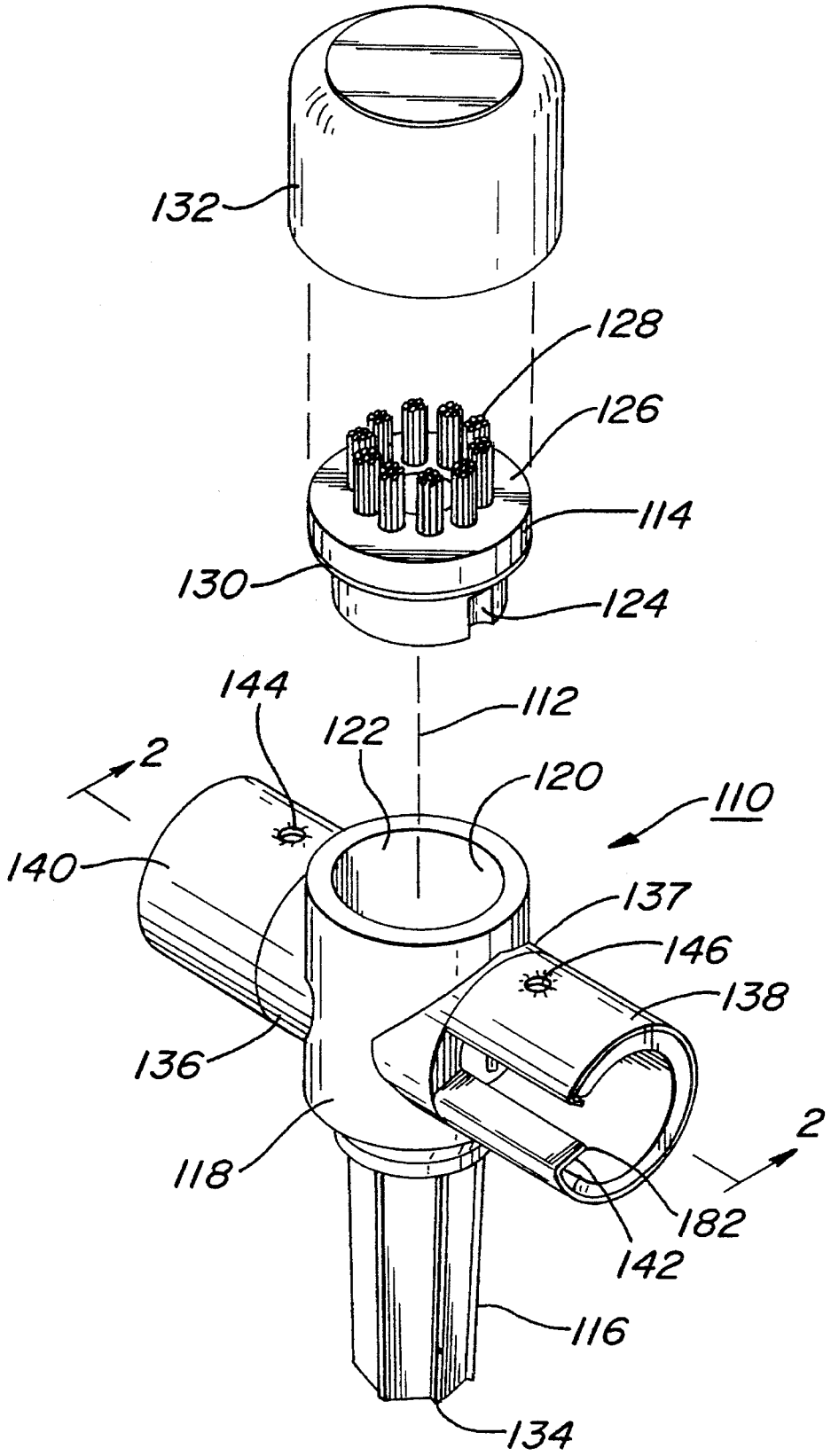
FIG. 1 is an exploded perspective view of one embodiment of the present invention.

The preferred battery tool of the present invention comprises three elements: a top portion; a bottom portion; and an intermediate portion connecting the top and bottom portions. It is contemplated that these three elements may be formed from distinct parts joined together by any known and applicable means, such as adhesive bonding and/or mechanical fastening. It is also contemplated that two or more of these elements may be integrally joined during the manufacture thereof, such as by forming two or more of the elements together in a single molding operation.

One important feature of the preferred battery cleaning tool is the use of a top portion which comprises brush means for cleaning contact surfaces and a bottom portion which comprises means for reaming and/or smoothing battery contacts. Applicant has found that a tool having such a unique configuration provides highly advantageous results, especially when the cleaning tool further comprises means for removably covering the brush means. More particularly, applicant has found that a battery cleaning tool configured in accordance with the present invention is readily adapted to fit comfortably in the hand of the user during either the cleaning or the reaming operation, as explained more fully hereinafter.

While a variety of embodiments of the battery cleaning tool are contemplated utilizing various intermediate and bottom portions wherein the intermediate portion has a cavity, preferably a cylindrical cavity for receiving the top portion, preferred embodiments of the battery cleaning tool utilize intermediate and bottom portions which are substantially similar to the corresponding sections of the battery tool disclosed and claimed in U.S. Pat. No. 3,802,793 to Murray L. Simon, which is incorporated herein by reference.

The versatility of the battery cleaning tool of the present invention results in part from the incorporation of brush means in the top portion of the tool. The brush means may be used to clean the contact surface of a battery pole or battery terminal. The design of the brush means may be optimized for the battery types most often cleaned by a given user. As an example, for battery cleaning tools intended for use primarily by truck mechanics and drivers, the brush design best suited to the cleaning of truck batteries is preferred.

The brush means preferably comprises relatively stiff bristles which are capable of scouring and removing surface materials on a battery pole or terminal which interfere with the electrical contact between the battery pole and terminal. Accordingly, it is desirable that the brush means is comprised of materials which are sufficiently stiff to scour the surface of a battery contact or terminal and retain their shape during the course of usage.

In preferred embodiments, the individual bristles which comprise the brush are metallic and may be made of steel or brass. It is preferred that the length of the bristles be sufficient to allow the bristles to touch the contact surface of a battery or terminal while allowing the user to rotate the brush freely such that the contact surface may be polished. While it is contemplated that the length of the individual bristles may vary widely within the scope of the present invention, it is generally preferred that the bristles have a length of from about 0.4 cm. to about 1.5 cm. In certain preferred embodiments, the bristles extend, on average, approximately 1 cm. from the surface of the battery cleaning tool. The arrangement of the bristles may take a variety of forms, depending on the application intended for the battery cleaning tool. For applications wherein the battery cleaning tool is to be used to clean side-post-mounted batteries, marine batteries and various types of batteries primarily used in trucks, it is preferred that the bristles are disposed around the periphery of a circular cavity in the top portion of the battery cleaning tool wherein the cavity allows entry of a battery post and the brushes therefore come in contact with the base of a battery post and allow one to polish this contact surface.

It is anticipated that a variety of other brush designs known to those skilled in the art may be used, such as brushes known as Christmas tree brushes and brushes which have their bristles disposed in a helical pattern. It is anticipated that the brush type having the greatest versatility is the brush type presented in the attached figures wherein the bristles of the brush are disposed in a circular arrangement around the periphery of a central cavity.

The battery tool may be manufactured from a variety of materials, such as plastic materials. It is preferred that the battery tool be manufactured using polystyrene.

Certain embodiments of the tool of the present invention may include additional materials which impart to the battery cleaning tool a color or colors, such as fluorescent colors, which are desirable from a marketing standpoint and do not necessarily impact on the mechanical functioning of the tool.

To ensure the safety of the user's hand while using the bottom portion of the tool which is intended to be used to ream or smooth the surface of a battery terminal, the preferred tool includes a protective cap for removably covering the bristles of the brush, thereby protecting the user's hand from possible contact with the brush.

The provision of a cap covering the bristles of the brush primarily protects the palm of the user's hand when the user is grasping the tool so that, by rotating his wrist, he can ream a battery terminal with the bottom portion of the tool. In addition, the cap provides protection of the user's fingers when, for example, the arms of the tool are used to ream or smooth the pole of a battery contact.

The cap may take a variety of forms, depending on the design of the brush. In all variants, however, the cap is designed to be securely retained on the top portion of the battery, preferably by means of a friction fit between the top portion of the battery cleaning tool and the cap.

The cap may be manufactured from a variety of materials, such as plastic materials. In preferred embodiments, the cap material is manufactured from polystyrene.

II. Manufacturing Considerations

The battery cleaning tool of the present invention allows for both variability and economy in the manufacturing process to provide battery cleaning tools having different brush members. The battery cleaning tool is manufactured so as to strengthen the tool against rotation of the top portion containing the brush relative to the intermediate portion of the tool. The intermediate portion of the battery cleaning tool contains a cavity which receives the top portion of the tool. For the majority of brush designs, the brushes are symmetrical about a central axis. Accordingly, there is no need to orient the brush relative to the body of the tool. However, applicants have found it advantageous to include within the cavity of the intermediate portion a projection which engages a notch on the top portion of the battery cleaning tool. This notch and projection strengthen the brush, as described above.

The provision of the projection in the intermediate portion of the battery tool provides for a load bearing surface which reduces the need for solvent welding or mechanically anchoring the top portion of the battery cleaning tool. Accordingly, the projection and notch together serve to maximize the strength of the bond between the top and intermediate portions of the tool, and thereby resist failure due to the mechanical rotational forces encountered in cleaning of a contact surface.

III. Description of Illustrated Embodiment

A preferred battery cleaning tool of the present invention is illustrated in FIG. 1. Tool body 110 comprises a top portion 114 coupled to an intermediate portion 118, which in turn is coupled to a bottom portion 116 that tapers away from the intermediate portion. The intermediate portion 118 includes a cavity 120 for receiving the top portion 114. The cavity 120 has an inner wall 122, and a notch 124 present in the outer wall of top portion 114 engages a projection 148 (FIG. 4) on the surface of the inner wall 122.

A brush member 126 is disposed on top portion 114. Brush member 126 is comprised of a plurality of filaments 128 which, as discussed hereinabove, can be manufactured from a variety of materials. The top portion 114 additionally has a cap retaining ring 130 which provides a frictional fit with the inner surface of cap 132.

Intermediate portion 118 includes arms 136 and 137, which are disposed substantially perpendicularly to longitudinal axis 112 of the tool body. Surrounding arms 136 and 137 are metal bands 138 and 140, respectively. As is best illustrated by reference to metal band 138, the metal bands include a blade 142. Metal bands 138, 140 are retained on arms 136, 137 by indentations 144 and 146. Bottom portion 116 contains a plurality of blade elements 134.

With particular reference to FIG. 2, top portion 114 is preferably secured to intermediate portion 118 by insertion of top portion 114 into the receiving cavity 120 of the intermediate portion 118. As mentioned above, intermediate portion 118 includes a projection 148 which engages notch 124 to assist in the prevention of rotational movement of top portion 114 relative to intermediate portion 118 during the cleaning of a battery contact surface.

FIG. 2 additionally illustrates cap 132 having an inner surface 150 and an outer surface 152 demountably engaged to top portion 114 by virtue of cap retaining ring 130. Rib 153 projecting from inner surface 150 bears against the surface of top portion 114 when cap 132 is attached to the battery cleaning tool. Inner surface 150 further includes a lip 154 disposed around the inner surface 150 of the cap to provide for a frictional fit with cap retaining ring 130, thereby removably retaining the cap over the brush member 126.

As illustrated in FIG. 2, arms 136 and 137 provide walls 155 and 157, which include inner surfaces 156, 158 and outer surfaces 160, 162. Both of the arms include a recess 164, 166 having a substantially circular cross-section which is designed to fit over the pole of a battery contact. Polarity symbols 168 and 170 are provided on the surface of the intermediate portion 118 to indicate to the user which recess is intended for cleaning a positive or negative pole of a battery. In the embodiment presented in FIG. 2, polarity symbol 170 is a positive sign and polarity symbol 168 is a negative sign. Substantially cylindrical metal bands 138, 140 are disposed over arms 136, 137. The bands are retained in place by indentations 144, 146 which engage band retaining cavities 174, 176 located on the surface of arms 136, 137. Metal bands 138, 140 provide blades 142 and 178, respectively, each of which extends through an opening in its respective arm and into the recess provided in the arm. Blades 142 and 178 each include edges 180 and 182, respectively, which are able to clean the contact poles of a battery.

FIG. 5, taken along line 5 in FIG. 2, illustrates blade members 134. As illustrated, the blades are substantially embedded in bottom portion 116, and extend from the longitudinal axis 112 to above the surface of the material used to prepare bottom portion 116. Each of the blades 134 has a first face 182 which is substantially embedded in bottom portion 116, and a second face 184 which is partially exposed on the surface of bottom portion 116. Second face 184 provides a surface for cleaning a battery contact.

What is claimed is:

1. A battery tool comprising:

a top portion; a bottom portion; and an intermediate portion connecting said top and bottom portions, said bottom portion tapering away from said intermediate portion;

said top, bottom and intermediate portions being aligned along a longitudinal axis;

said intermediate portion having a cavity therein for receiving said top portion, said cavity having an inner wall, and a projection extending into said cavity from the surface of said inner wall;

said top portion being at least partially contained in said cavity and having a notch thereon for mating with said projection;

said top portion having a brush member disposed integral with said top portion thereon; said brush member comprising a plastic body portion and filaments embedded in said top portion, said filaments being disposed substantially parallel to said longitudinal axis.

2. A battery tool comprising:

a top portion; a bottom portion; and an intermediate portion connecting said top and bottom portions, said bottom portion tapering away from said intermediate portion;

said top, bottom and intermediate portions being aligned along a longitudinal axis;

said intermediate portion having a cavity therein for receiving said top portion, said cavity having an inner wall, and a projection extending into said cavity from the surface of said inner wall;

said top portion being at least partially contained in said cavity and having a notch thereon for mating with said projection;

said top portion having a brush member disposed integral with said top portion thereon;

said brush member comprising a plastic body portion and filaments embedded in said top portion, said filaments being disposed substantially parallel to said longitudinal axis;

said top portion having a cap retaining ring disposed around the circumference of said top portion.

3. A battery tool comprising:

a top portion; a bottom portion; and an intermediate portion connecting said top and bottom portions, said bottom portion tapering away from said intermediate portion;

said top, bottom and intermediate portions being aligned along a longitudinal axis;

said intermediate portion having a cavity therein for receiving said top portion, said cavity having an inner wall, and a projection extending into said cavity from the surface of said inner wall;

said top portion being at least partially contained in said cavity and having a notch thereon for mating with said projection;

said top portion having a brush member disposed integral with said top portion thereon;

said brush member comprising a plastic body portion and filaments embedded in said top portion, said filaments being disposed substantially parallel to said longitudinal axis;

said top portion having a cap retaining ring disposed around the circumference of said top portion having a cap removably attached to and covering said brush member, said cap having inner and outer surfaces, said inner surface of said cap having a lip disposed around the inner surface of said cap, said lip providing a frictional fit with said cap retaining ring thereby removably retaining said cap over said brush member.

4. A battery tool comprising:

an elongate body of plastic material having: a longitudinal axis; a top portion; a bottom portion; and an intermediate portion connecting said top and bottom portions, said bottom portion tapering away from said intermediate portion;

said bottom portion having a plurality of at least three blade elements angularly spaced and substantially embedded in said bottom portion, said blade elements extending from said longitudinal axis and having first and second faces wherein said second face of each of said blades is partially exposed on the surface of said bottom portion thereby providing a surface for cleaning a battery contact;

said intermediate portion of said body including a pair of oppositely extending arms substantially perpendicular to said longitudinal axis, each of said arms having a recess providing a wall with inner and outer surfaces of substantially circular cross-section and having an opening in said wall communicating with said recess, each of said arms having a substantially cylindrical metal band removably receivable over the outer surface thereof, each of said bands having an edge providing a blade extending into said opening of the respective arms through said opening in said wall;

said intermediate portion having a substantially cylindrical cavity for receiving said top portion, the axis of said cavity being substantially coextensive with the longitudinal axis of said body, said cavity having an inner wall, said inner wall having a radial projection;

said top portion having a notch thereon for engaging said projection and thereby securing said top portion to said intermediate portion;

said top portion having a brush member disposed integral with said top portion thereon, said brush member comprising a plastic body portion and filaments embedded therein, said filaments being disposed substantially parallel to said longitudinal axis; said top portion having a cap retaining ring disposed around the circumference of said top portion, said cap retaining ring defining a junction between said top portion and said intermediate portion;

a cap, removably attached to and covering said brush member, said cap having inner and outer surfaces, said inner surface of said cap having a lip disposed around the inner surface of said cap, said lip providing a frictional fit with said cap retaining ring thereby removably retaining said cap over said brush member.

* * * * *